US010957526B2

(12) United States Patent
Baba

(10) Patent No.: US 10,957,526 B2
(45) Date of Patent: Mar. 23, 2021

(54) SPATIAL, MASS AND ENERGY FOCUSED ION INJECTION METHOD AND DEVICE

(71) Applicant: DH Technologies Development Pte. Ltd., Singapore (SG)

(72) Inventor: Takashi Baba, Richmond Hill (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 16/348,381

(22) PCT Filed: Nov. 2, 2017

(86) PCT No.: PCT/IB2017/056819
§ 371 (c)(1),
(2) Date: May 8, 2019

(87) PCT Pub. No.: WO2018/087634
PCT Pub. Date: May 17, 2018

(65) Prior Publication Data

US 2019/0267228 A1 Aug. 29, 2019

Related U.S. Application Data

(60) Provisional application No. 62/420,900, filed on Nov. 11, 2016.

(51) Int. Cl.
*H01J 49/06* (2006.01)
*H01J 49/42* (2006.01)

(52) U.S. Cl.
CPC ..... *H01J 49/067* (2013.01); *H01J 49/4245* (2013.01); *H01J 49/4255* (2013.01);
(Continued)

(58) Field of Classification Search
CPC ..... H01J 49/4255; H01J 49/4245; H01J 49/4295; H01J 49/062; H01J 49/067; H01J 49/4225; H01J 49/423
See application file for complete search history.

(56) References Cited

U.S. PATENT DOCUMENTS 6,104,029 A * 8/2000 Coxon ..... H01J 49/067 250/305
2003/0226965 A1* 12/2003 Guevremont ..... G01N 21/3504 250/290

(Continued)

FOREIGN PATENT DOCUMENTS

WO 2013122880 A2 8/2013

OTHER PUBLICATIONS

International Search Report and Written Opinion for PCT/IB2017/056819 dated Mar. 6, 2018.

(Continued)

*Primary Examiner* — Wyatt A Stoffa

(57) ABSTRACT

In one aspect, an ion trap is disclosed, which includes a curved linear ion trap having a plurality of electrodes arranged around a central curved axis so as to provide a volume for trapping ions, said plurality of electrodes comprising at least one inner electrode and at least one outer electrode radially separated from said inner electrode. The ion trap further includes a pair of inner and outer ion guide electrodes providing a volume therebetween for receiving ions ejected from said curved ion trap and guiding the ejected ions to one or more spatial locations along a focal line, said inner and outer ion guide electrodes being positioned external to said ion trapping volume and in proximity of said at least inner and outer electrodes of the curved ion trap, respectively, wherein a DC voltage is applied between said ion guide electrodes to provide an electric filed therebetween for guiding the ejected ions to said spatial locations.

20 Claims, 10 Drawing Sheets

(52) U.S. Cl.
CPC ..... *H01J 49/4295* (2013.01); *H01J 49/062* (2013.01); *H01J 49/423* (2013.01); *H01J 49/4225* (2013.01)

(56) References Cited

U.S. PATENT DOCUMENTS

| | | | | |
|---|---|---|---|---|
| 2005/0121609 | A1* | 6/2005 | Makarov | B82Y 30/00 250/290 |
| 2008/0191129 | A1* | 8/2008 | Makarov | H01J 49/04 250/282 |
| 2009/0001265 | A1* | 1/2009 | Baba | G01N 27/622 250/288 |
| 2011/0284737 | A1* | 11/2011 | Makarov | H01J 49/427 250/282 |
| 2013/0068942 | A1* | 3/2013 | Verenchikov | H01J 49/401 250/282 |
| 2016/0005579 | A1* | 1/2016 | Krutchinsky | H01J 49/424 250/293 |
| 2016/0155624 | A1 | 6/2016 | Verenchikov et al. | |
| 2017/0098536 | A1* | 4/2017 | Remes | H01J 49/425 |
| 2017/0352530 | A1* | 12/2017 | Belov | H01J 49/063 |
| 2017/0365456 | A1* | 12/2017 | Verenchikov | H01J 49/401 |
| 2018/0366313 | A1* | 12/2018 | Hoyes | H01J 49/062 |

OTHER PUBLICATIONS

Richard H. Perry et al., "Orbitrap Mass Spectrometry: Instrumentation, Ion Motion and Applications", Mass Spectrometry Reviews, vol. 27, Issue 6, Dec. 2008, pp. 661-699.

* cited by examiner

SPATIAL, MASS AND ENERGY FOCUSED ION INJECTION METHOD AND DEVICE

RELATED APPLICATIONS

This application claims priority to U.S. provisional application No. 62/420,900, filed on Nov. 11, 2016, entitled "Spatial, Mass and Energy Focused Ion Injection Method and Device," which is incorporated herein by reference in its entirety.

FIELD

The present disclosure relates generally to ion traps, and more particularly to ion traps that can allow spatial, mass and energy focusing of ions.

INTRODUCTION

Ion traps are employed in a variety of different mass spectrometer systems. For example, in FT-ICR mass spectrometers, spatial, mass and energy focusing of ions is generally desired. However, such focusing poses a number of challenges. For example, when ions exhibit a kinetic energy spread, they can be spatially defocused after traveling from a trapping device to a downstream mass analyzer, which can adversely affect the performance of the mass analyzer.

In some conventional ion trapping devices, ions are extracted axially from the end of the trap. One disadvantage of such traps is that the extracted ions can experience spatial defocusing in length. To overcome such spatial defocusing, a trap commonly known as "C trap" employs radial extraction of ions from a curved linear ion trap, as shown schematically in FIG. 1. Such a trap cannot, however, provide energy focusing of the ejected ions.

Accordingly, there is a need for enhanced systems and methods for trapping ions, e.g., in mass spectrometry applications.

SUMMARY

In one aspect, an ion trap is disclosed, which includes a curved linear ion trap having a plurality of electrodes arranged around a central curved axis so as to provide a volume for trapping ions, said plurality of electrodes comprising at least one inner electrode (e.g., disposed radially inward from the curved central axis) and at least one outer electrode (e.g., disposed radially outward from the curved central axis) radially separated from said inner electrode. The ion trap further includes a pair of inner and outer ion guide electrodes that provide a volume therebetween for receiving ions ejected from said curved linear ion trap and that guide the ejected ions to one or more spatial locations along a focal line, said inner and outer ion guide electrodes being positioned external to said ion trapping volume and in proximity of the inner and outer electrodes of the curved ion trap, respectively, wherein a DC voltage is applied between said ion guide electrodes to provide an electric filed therebetween for guiding the ejected ions to said spatial locations along the focal line. In various aspects, the ion trap can include an exit aperture positioned in proximity of said spatial locations through which the ions converged on those spatial locations can exit, e.g., to propagate to components disposed downstream of the ion trap.

In some embodiments, the ion guide electrodes are configured to receive the ejected ions along directions substantially orthogonal to said curved central axis.

In some embodiments, each of the inner and the outer ion guide electrodes can be in the form of a truncated spherical surface (e.g., a section of a hemispherical surface). In some embodiments, the spherically-shaped surfaces can be positioned concentrically relative to one another, i.e., the centers of the corresponding spheres can be coincident. In some such embodiments, the focal line can be along a radial direction extending from the common centers of the spheres to the spherical surfaces.

The ion trap can further include a radiofrequency (RF) generator for applying one or more RF voltages to one or more electrodes of the curved linear ion trap for trapping ions therein. By way of non-limiting example, the RF voltages can have a frequency in a range of about 0.1 MHz to about 10 MHz and an amplitude in a range of about 10 V to about 10 kV.

In various aspects, the ion trap can also include a switchable DC voltage source for applying an extraction DC voltage to at least one electrode of the curved linear ion trap for ejecting at least a portion of trapped ions into the volume between the ion guide electrodes. By way of example, the applied extraction DC voltage can be in a range of about 0.1 volts to about 100 volts (e.g., so as to eject the ions from the trap between the inner and outer electrode).

In some aspects, the curved linear ion trap can be a curved quadrupole trap. In some aspects, the quadrupole trap can comprise eight elongated electrodes, with four pairs of the eight electrodes being electrically-connected (e.g., shorted) as in the form of a slotted quadrupole. For example, the quadrupole can include a pair of curved inner electrodes and a pair of curved outer electrodes radially separated from the pair of curved inner electrodes, a pair of curved bottom electrodes and a pair of curved top electrodes separated from one another along a vertical direction. In such embodiments, the two ion guide electrodes can be configured to receive the ejected ions along a vertical direction (e.g., along a direction substantially parallel to the focal line), for example, via passage through a gap between the upper electrodes of the quadrupole trap.

In some embodiments, the RF generator can be configured to apply at least one scanned RF voltage, e.g., in combination with a DC extraction voltage, to one or more electrodes of the curved ion trap for a selected time duration so as to achieve mass focusing of the ejected ions. By way of example, the duration of applied RF voltage scan can be in a range of about 0.1 ms to about 10 ms. In some embodiments, the scanned RF voltage can have a temporally-varying amplitude, e.g., an amplitude that changes from a maximum value (e.g., 1000 V) to a minimum value (e.g., 0 V) during the time period in which the scanned RF voltage is applied.

In some aspects, the ion trap can further include a DC focusing lens disposed between the curved linear ion trap and said inner and outer ion guide electrodes so as to focus the ejected ions into the volume between the ion guide electrodes. For example, the DC focusing lens can include a stack of a plurality of electrode pairs, wherein each of said electrode pairs comprises two electrodes spaced from one another so as to provide a gap therebetween for passage of the ejected ions. In some embodiments, a DC voltage differential can be applied between the electrode pairs of the DC focusing lens, e.g., a DC voltage differential in a range of about −10V to about +10V, for generating a field suitable for focusing the ejected ions into the volume between the inner and the outer ion guide electrodes.

In accordance with various aspects of the present teachings, an ion trap device is disclosed, which includes a linear curved ion trap comprising a plurality of curved electrodes arranged to provide a volume therebetween for storing ions, and a DC ion guide comprising a plurality of spherically-shaped electrodes coupled to the linear curved ion trap so as to receive ions ejected from the linear curved ion trap and to guide said ions onto one or more spatial locations along a focal line. In some embodiments, the spherically-shaped electrodes can be concentrically positioned so as to have a common center of curvature. In some such embodiments, the focal line can be along a radial line extending from the common center of the spherical electrodes to those electrodes.

In accordance with various aspects of the present teachings, a method of trapping ions is disclosed, which includes injecting a plurality of ions into a curved linear ion trap, applying at least one RF voltage to said curved linear ion trap so as to trap said ions, and applying a DC extraction voltage to said curved linear ion trap so as to eject at least a portion of said trapped ions into a volume between two spherically-shaped DC-biased electrodes coupled to said curved linear ion trap so as to guide the ions to one or more spatial locations within the volume.

Further understanding of the various aspects of the invention can be obtained by reference to the following detailed description in conjunction with the associated drawings, which are described briefly below. These and other features of the applicant's teachings are set forth herein.

BRIEF DESCRIPTION OF THE DRAWINGS

The skilled person in the art will understand that the drawings, described below, are for illustration purposes only. The drawings are not intended to limit the scope of the applicant's teachings in any way.

DETAILED DESCRIPTION

The present teachings relate generally to an ion trap device that includes a curved linear ion trap for storing ions and a DC ion guide that can receive ions ejected from the curved linear ion trap and guide those ions to spatial locations along a focal line for transmission to other components in communication with the ion trap. In various aspects, an ion trap according to the present teachings can be incorporated in a mass spectrometer system.

Various terms are used herein consistent with their ordinary meanings in the art. In particular, the term "ion trap" as used herein refers to a device that can store ions by employing magnetic and/or electric fields. The term "spherically-shaped" as used herein refers to a surface that forms at least a portion of a sphere. The term "scanned RF voltage" refers to a radiofrequency voltage, e.g., with a frequency in a range of about 0.1 MHz to about 10 MHz, the amplitude of which monotonically increases or decreases over a given time period, e.g., over a time period in a range of about 0.1 ms to about 10 ms. The term "about" as used herein denotes a variation of at most 10% around a numerical value. The term "substantially" as used herein denotes a deviation of less than 5% from a complete state or condition.

Figure 2:
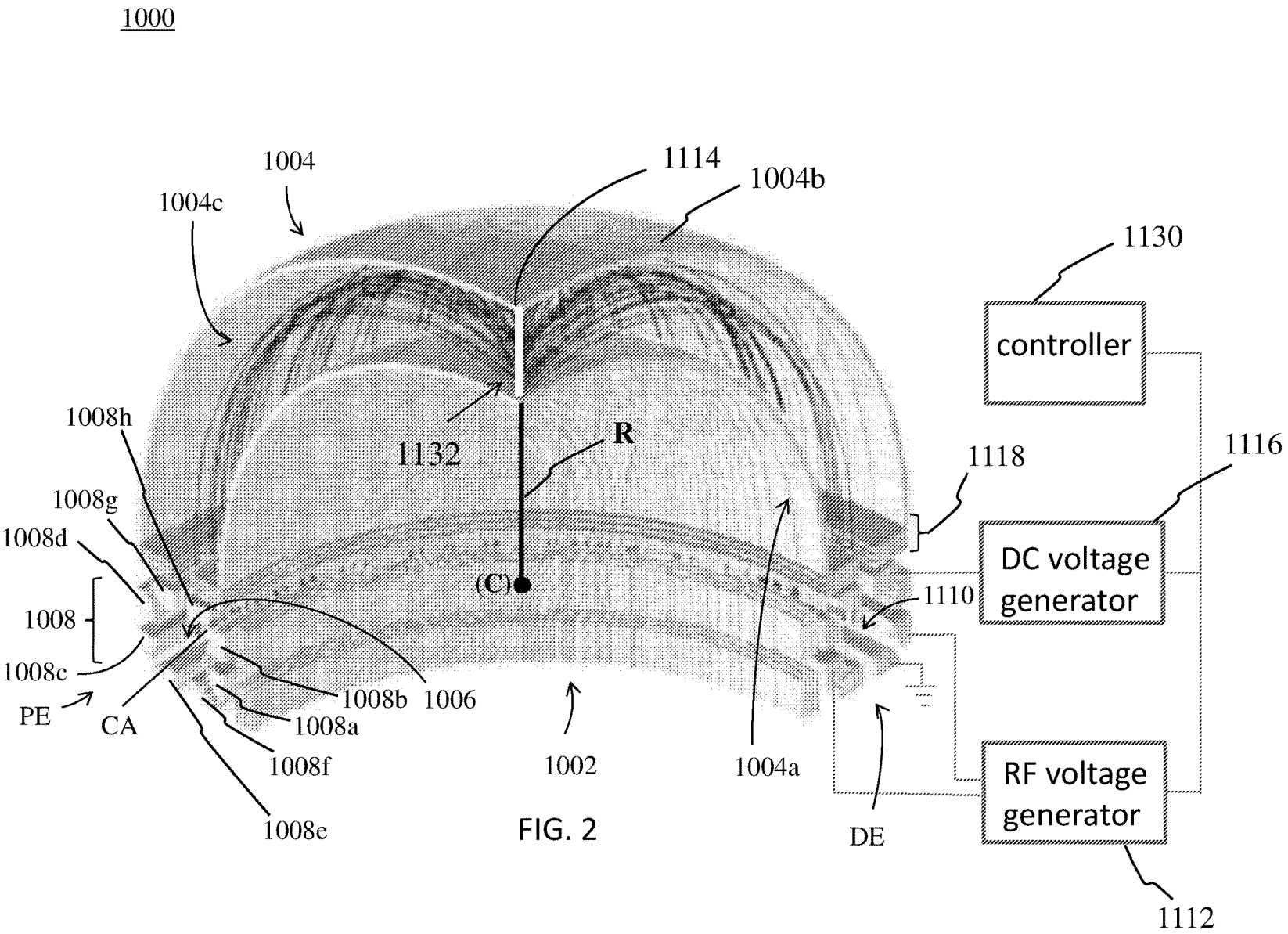
FIG. 2 schematically depicts an ion trap system according to various aspects of the present teachings.

FIG. 2 schematically depicts an ion trap 1000 according to various aspects of the present teachings, which includes a curved linear ion trap 1002 and a DC ion guide 1004 that is coupled to the curved linear ion trap 1002 so as to receive ions ejected from the linear ion trap and guide those ions to one or more selected spatial locations, as discussed in more detail below. As shown, the curved linear ion trap 1002 extends from a proximal end (PE) to a distal (DE) and includes an input orifice 1006 for receiving ions from one or more upstream components, such as an ion source, an ion guide, etc. The exemplary ion trap 1000 includes four pairs of electrodes 1008 (e.g., eight rods, a slotted quadrupole) that are arranged around a curved central axis (CA) so as to provide an electromagnetic field (e.g., an electric field having a quadrupolar component) for trapping ions injected into the linear ion trap within the ion trapping volume 1110 defined by the electrodes 1008. As shown, each of the electrodes 1008 is in the form of a curved rod extending from the proximal end (PE) of the ion trap to its distal end so as to collectively define the curved ion trapping volume 1110. More specifically, the curved linear ion trap 1002 includes a pair of inner electrodes 1008*a*/1008*b* and a pair of outer electrodes 1008*c*/1008*d*, which are radially offset from the inner electrodes 1008*a*/1008*b*. Additionally, the electrodes 1008 further include a pair of bottom electrodes 1008*e*/1008*f* and a pair top electrodes 1008*g*/1008*h*. As discussed otherwise herein, a slot between the electrodes of an electrode pair (e.g., a slot between the top electrodes 1008*g*/1008*h*) can allow for the transmission therethrough of ions ejected from the curved linear ion trap 1008. In various aspects, the electrodes of each pair (e.g., inner electrodes 1008*a*/1008*b*) can be electrically connected (e.g., shorted) such that an electrical signal applied to one electrode in the pair will similarly be applied to the other. It will be appreciated that the electrodes 1008 can have a variety of cross-sectional shapes (e.g., round, hyperbolic, stepped inner surfaces), with each of the pairs operable to function as a slotted quadrupole electrode.

As is generally known in the art and modified in accordance with the present teachings, an RF voltage generator 1112 can apply one or more voltages to the electrodes 1008, (e.g., an RF voltage to the various electrodes 1008 such that adjacent pairs of electrodes exhibit the opposite phase to the adjacent pair) to provide trapping electromagnetic fields so as to store the received ions within the ion trapping volume 1110. For example, one or more RF voltages, e.g., at a frequency in a range of about 0.1 MHz to about 10 MHz and an amplitude in a range of about 10 V to about 10 kV, can be applied to one or more of the electrodes 1008 to confine ions within the trapping volume 1110. In some embodiments, the curved linear ion trap 1002 may include an endcap electrode at its proximal and distal ends to which a DC voltage can be applied to assist with axial confinement of the ions within the curved linear ion trap 1002. The trapping of the ions by the curved linear ion trap 1002 can be used for a variety of different purposes. For example, the trapped ions can undergo translational cooling or collision-induced dissociation to generate ion fragments, which can be detected and analyzed via downstream components, such as a mass analyzer.

With continued reference to FIG. 2, the DC ion guide 1004 can include an inner ion guide electrode 1004*a* and an outer ion guide electrode 1004*b*, which provide a volume 1004*c* therebetween for receiving ions ejected from the curved linear ion trap 1002 and for guiding those ions to converge onto a plurality of spatial points along a focal line 1114. More specifically, the ions ejected from the curved linear ion trap 1002 can pass through a gap between the upper electrodes 1008*g*/1008*h* to enter the space between the two ion guide electrodes 1004*a*/1004*b*.

Though the inner guide electrode 1004*a* is depicted in the form of a truncated spherical shell and is positioned external to the ion trapping volume 1110 of the curved linear ion trap 1002 in proximity of the inner electrode pair 1008*a*/1008*b*, it will be appreciated that the inner shell can exhibit a variety of geometries that include, by way of non-limiting example, a portion of an ellipsoid, spheroid, ovoid, or sphere. Likewise the outer guide electrode 1004*b* can have a variety of configurations but is depicted in FIG. 2 in the form of a truncated spherical shell that is positioned external to the ion trapping volume 1110 of the curved linear ion trap in proximity of the outer electrode pair 1008*c*/1008*d* of the curved linear ion trap 1002. It will be appreciated that the ion guide electrodes 1004*a*/1004*b* can be fixedly arranged relative to the electrodes of the curved linear ion trap 1002 using mechanisms known in the art, e.g., brackets, fasteners, etc.

In various aspects, the spherically-shaped inner and outer shells 1004*a*/1004*b* can be concentric, i.e., they have a common center (C). Further, in some aspects, the focal line can extend along a radial direction (R) extending from the common center (C) to the spherically-shaped shells. The radius of curvature of the inner and the spherical shells forming the inner and the outer guide electrodes can be selected based, for example, on types of ions and/or a particular application for which the ion trap is intended. By way of non-limiting example, in some embodiments, the truncated spherical shell forming the inner ion guide electrode 1004*a* can have a radius of curvature in a range of about 50 mm to about 500 mm and the truncated spherical shell forming the outer ion guide electrode 1004*b* can have a radius of curvature in a range of about 50 mm to about 500 mm.

In accordance with various aspects of the present teachings, a DC voltage generator 1116 can apply a DC voltage differential between the inner and outer ion guide electrodes 1004*a*/1004*b* so as to generate an electric field in the space between those electrodes, where the electric field is effective to guide the ions received from the curved linear ion trap onto one or more spatial point(s) along the focal line 1114. It will be appreciated in light of the present teachings that the polarity of the applied DC voltage differential can be selected based on the charge of the ions (i.e., whether positive or negative) such that the electric field causes the received ions to converge onto spatial locations along the focal line 1114. By way of example, in some embodiments, a DC voltage differential in a range of about 0 volts to about 50 volts can be applied between the inner and the outer guide electrodes 1004*a*/1004*b*.

Figure 3:
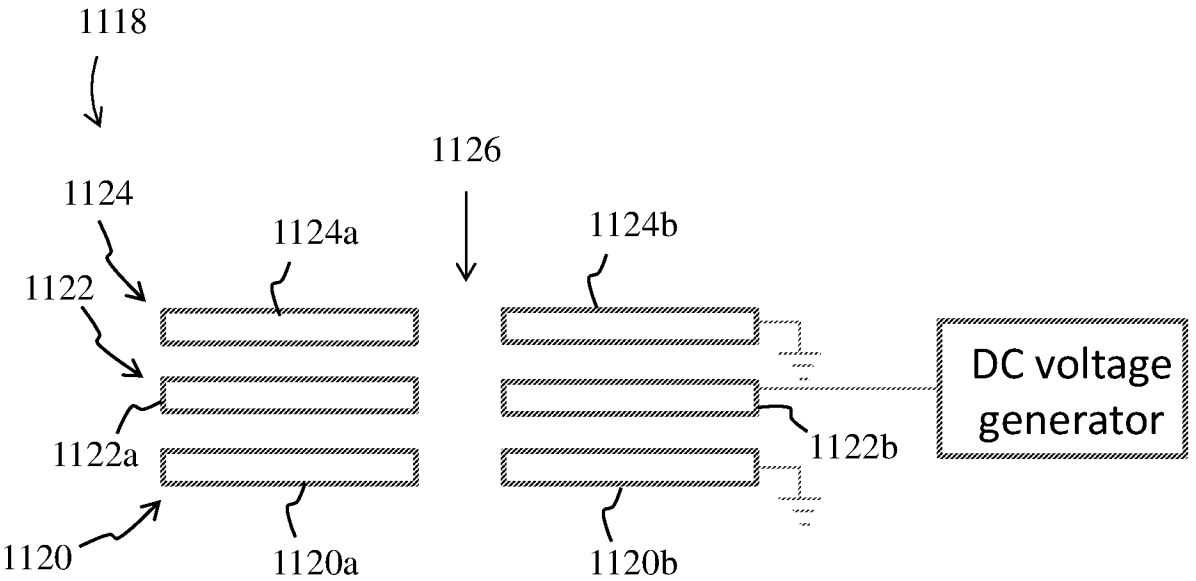
FIG. 3 is a schematic end view of an electrostatic lens employed in the ion trap of FIG. 2 according to various aspects of the present teachings.

With reference to FIG. 2 as well as FIG. 3, an electrostatic ion lens 1118, for example, comprising a stack of three pairs of curved electrodes 1120, 1122, and 1124 can be optionally disposed above the upper electrode pair 1008*g*/1008*h* of the curved linear ion trap 1002 in proximity of the entrance of the space 1004*c* between the inner and the outer spherically-shaped guide electrodes 1004*a*/1004*b*. As shown, each electrode 1120, 1122, 1124 can be composed of two spaced-apart electrodes forming a gap therebetween through which the ions ejected from the ion trapping volume 1110 can pass to reach the space between the two spherically-shaped ion guide electrodes 1004*a*/1004*b*. As shown, electrode pair 1120 is composed of spaced-apart electrodes 1120*a*/1120*b*, electrode pair 1122 is composed of spaced-apart electrodes 1122*a*/1122*b*, and electrode pair 1124 is composed of spaced-apart electrodes 1124*a*/1124*b*, which collectively provide a passageway 1126 disposed above the gap between the electrodes of the upper electrode pair 1008*g*/1008*h* of the linear ion trap 1002 and substantially aligned therewith, through which the ejected ions can pass to reach the space 1004*c* between the spherically-shaped ion guide electrodes 1004*a*/1004*b*.

In such aspects, the DC voltage generator 1116 can apply voltage differentials between the electrode pairs 1120/1122/1124 so as to generate an electric field within the passageway 1126 suitable for focusing the ions into the space between the ion guide electrodes 1004*a* and 1004*b*. By way of non-limiting example, the center electrode pair 1122 can be biased positively relative to the bottom and top electrode pairs 1120/1124 so as to focus the ions passing through the gaps between the electrodes of each pair into the space between the ion guide electrodes 1004*a* and 1004*b*. In some embodiments, the bias voltage applied to the center electrode pair 1122 can be in a range of about −20 volts to about +20 volts, though other voltages can also be employed depending, for example, on the type of ions and a particular application for which the ion trap is employed.

With continued reference to FIGS. 2 and 3, the switchable voltage source 1116 can apply a voltage differential (herein also referred to as an ejection voltage or an extraction voltage) between the lower electrode pair 1008*e*/1008*f* and the top electrode pair 1008*g*/1008*h* of the linear ion trap so as to cause the ejection of the ions trapped within the ion trapping volume 1110 via the gap between the rods of the upper electrode pair 1008*g*/1008*h* and the passageway provided between the electrodes of the electrostatic lens 1118 into the space 1004*c* between the ion guide electrodes 1004*a* and 1004*b*. In some aspects, the RF trapping voltage(s) applied to the electrodes of the linear ion trap 1002 may be reduced, or set to zero, during the application of the ejection voltage. In some embodiments, the ejection voltage can be, for example, in a range of about −20 volts to about +20 volts. As shown, the application of RF and DC voltage to the electrodes can be done under control of a controller 1130.

The ion trap 1000 further includes an exit aperture 1132 through which ions focused on the spatial location(s) along the focal line 1114 can exit the trap, e.g., toward downstream component(s) in a mass spectrometer in which the ion trap 1000 is incorporated.

In use, ions are injected into the curved linear ion trap 1002 to be stored within the ion trapping volume 1110 provided between the electrodes 1008. In various aspects, ions received within the curved linear ion trap 1002 may be trapped within the ion trapping volume 1110 for a period of time (e.g., of the order of milliseconds) sufficient for cooling of the translational motion of the ions. Subsequently, the ions can be ejected, via application of the ejection voltage to the lower and the upper electrode pairs of the curved linear ion trap 1002, along a vertical direction (i.e., along directions substantially orthogonal to the center axis (CA)) into the space between the spherically-shaped ion guide electrodes 1004*a* and 1004*b*. As noted above, during the ejection of the ions from the linear ion trap, the RF voltage(s) applied to the electrodes of the linear ion trap can be reduced or set to zero. By way of example, for positive ions, the bottom pair of electrodes 1008*e*/1008*f* can be biased positively compared to the top electrode pair 1008*g*/1008*h*, and for negative ions, the polarity can be reversed.

The electric field between the inner and the outer spherically-shaped guide electrodes 1004*a*/1004*b* can have a spherical configuration that causes the ions to travel along curved paths in the space 1004*c* between the two electrodes and converge on one or more spatial location(s) identified by the focal line 1114. By way of example, to obtain a curved travelling path in the space between the spherically-shaped ion guide electrodes 1004*a*/1004*b* as depicted in FIG. 2, the outer electrode 1004*b* can be biased positively relative to the inner electrode 1004*a* for positive ions, and for negative ions, the voltage polarity can be reversed. In various aspects, the flight length for ions placed at different axial positions in the curved linear ion trap 1002 can be substantially identical from the trap 1002 center to the focal line 1114 (e.g., due to the concentric spherical shape). In such a manner, the ion extraction from the linear trap can be achieved with spatial focusing in accordance with various aspects of the present teachings.

Moreover, the spherical electric field configuration between the inner and the outer guide electrodes 1004*a*/1004*b* can in some aspects provide for energy focusing—a feature not realized in prior art C traps. In other words, the spherical electric field between the ion guide electrodes 1004*a*/1004*b* can ensure that ejected ions having different energies, e.g., ions with an energy spread in a range of about 1 eV and 2 eV, arrive substantially concurrently at the focal line 1114. In particular, ions having lower kinetic energies can travel along trajectories between the ion guide electrodes 1004*a*/1004*b* characterized by smaller radii while ions having higher kinetic energies travel along trajectories characterized by larger radii. In this manner, the shorter trajectory for ions of lower kinetic energy can compensate for the lower velocity of such ions and the longer ion trajectory for ions of higher kinetic energy can compensate for the higher velocity of those ions such that all ions entering the space between the ion guide electrodes substantially at the same time arrive substantially concurrently at the spatial locations along the focal line 1114. Hence, the ion guide electrodes 1004*a*/1004*b* can be used to realize energy focusing, i.e., the ion arrival time at focal point(s) along the focal line 1114 exhibits reduced dependence on the kinetic energy of the ejected ions so long as the ions have the same mass-to-charge ratios (i.e., the same m/z). It will therefore be appreciated by those skilled in the art, that ion traps according to various aspects of the present teachings can therefore provide both spatial as well as energy focusing.

Figure 1:
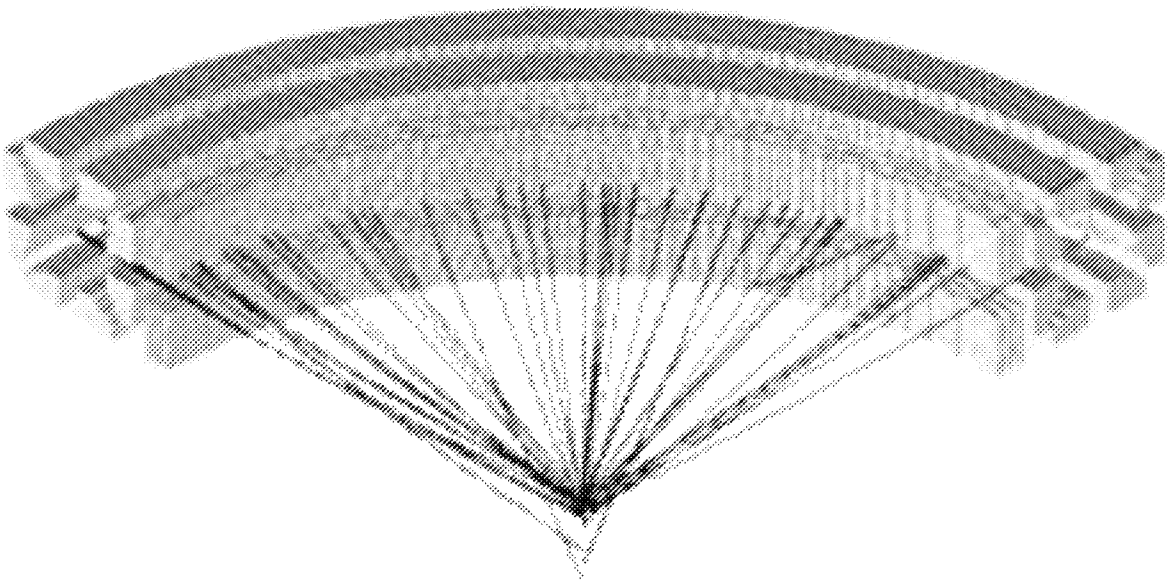
FIG. 1 schematically depicts a prior art curved linear ion trap.
Figure 4A:
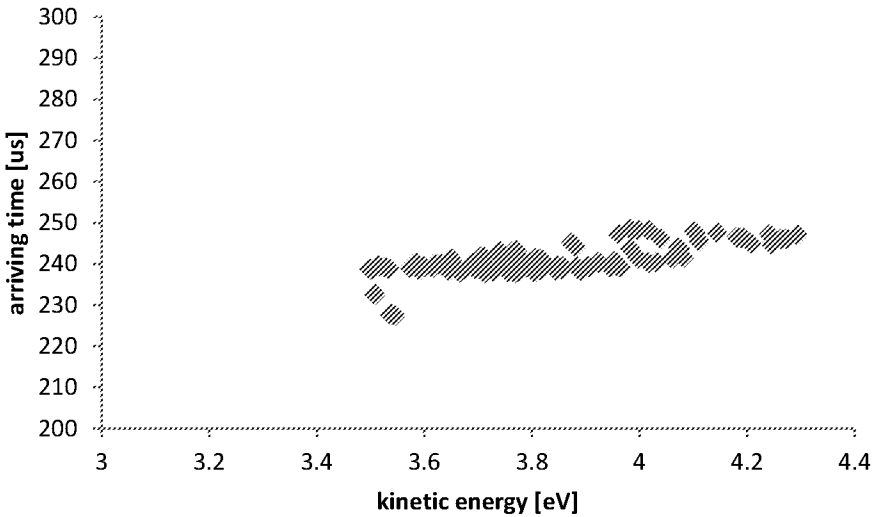
FIG. 4A shows simulated arrival times of ions ejected from the linear ion trap of FIG. 2 at focal points within the space between spherically-shaped ion guide electrodes as a function of the kinetic energy of the ejected ions.
Figure 4B:
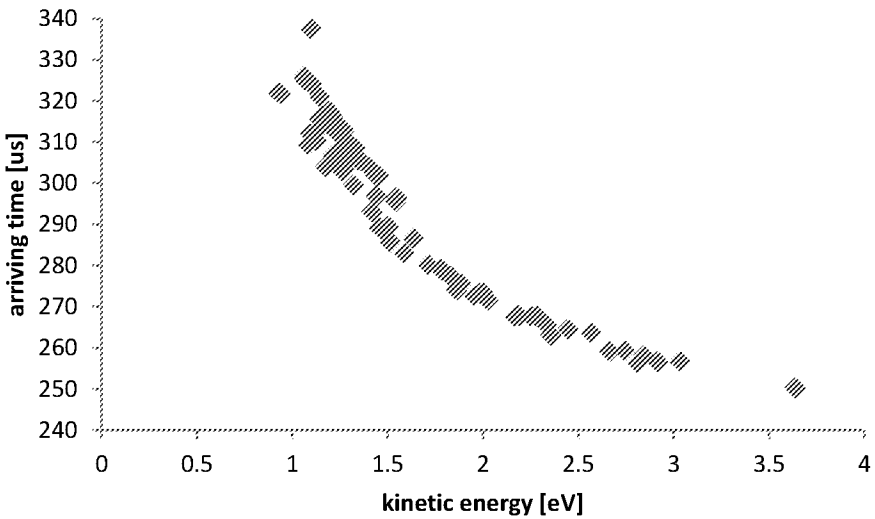
FIG. 4B depicts simulated data for a prior art C trap, showing that the kinetic energies of the ions significantly affect the ion arrival times at the focal point(s).

By way of illustration, FIG. 4A shows simulated arrival times of ions ejected from a curved linear ion trap according to various aspects of the present teachings at focal points within the space between the spherically-shaped ion guide electrodes as a function of the kinetic energy of the ejected ions. This simulated data demonstrates that the ions exhibit substantially identical arrival times at the focal points regardless of their kinetic energies. In other words, the simulated data shows that the ion trap exhibits energy focusing. In contrast, FIG. 4B shows respective simulated data for a prior art C trap (e.g., as shown in FIG. 1), demonstrating that the kinetic energies of the ions can significantly affect the ion arrival times at the C trap's focal point.

In various aspects, a combination of a DC extraction field and a scanned RF field can also be employed to achieve mass focusing of the ions ejected from the curved ion trap 1002. In particular, it has been discovered that by adjusting the time duration of an applied scanned RF voltage having an amplitude that decreases or increases, typically monotonically, over that duration, mass focusing of the ions ejected from the curved linear ion trap can be achieved. In other words, adjusting the time duration of the applied scanned RF voltage can additionally result in ions having different m/z ratios nonetheless being focused on the focal line 1114.

Figure 5A:
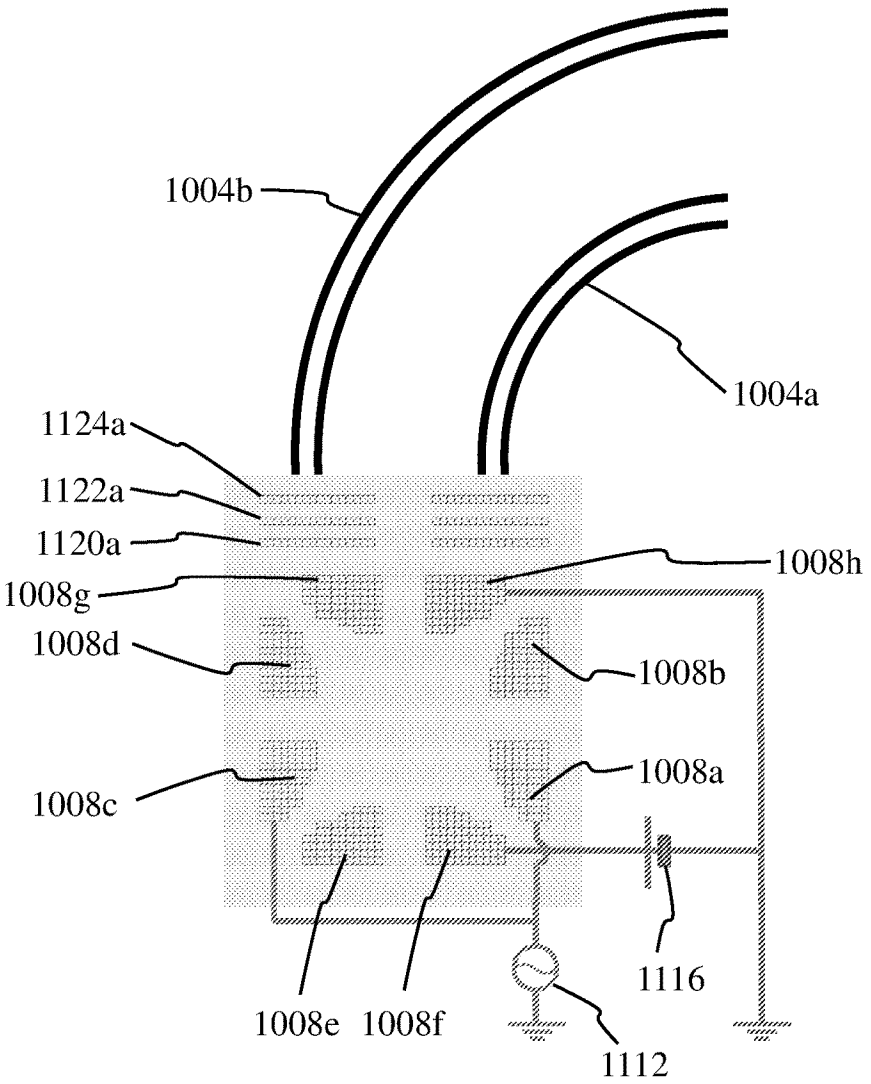
FIG. 5A shows the application of an extraction DC voltage differential and a scanned RF voltage to electrodes of the curved linear ion trap of an ion trap according various aspects of the present teachings for achieving mass focusing of the ions ejected from the curved linear ion trap.

By way of example, FIG. 5A shows the application of an extraction DC voltage differential between the lower electrode pair 1008*e*/1008*f* and the upper electrode pair 1008*g*/1008*h* of the curved linear ion trap 1002 by the switchable DC voltage source 1116, and the application of a scanned RF voltage differential between the inner electrode pair 1008*a*/1008*b* and the outer electrode pair 1008*c*/1008*d* of the curved linear ion trap 1002 so as to cause the ejection of ions from the curved linear ion trap into the space between the spherically-shaped ion guide electrodes 1004*a* and 1004*b* (e.g., through the slot in the upper electrode pair 1008*g*/1008*h*) such that ions with different m/z ratios (e.g., a variation of m/z ratios in a range of about 100 to 500) arrive substantially concurrently at the focal line 1114. By way of non-limiting example, the extraction DC voltage differential can be in a range of about −10 V to about +10V, and the RF voltage can have a frequency in a range of about 0.1 MHz to about 10 MHz. In some aspects, the amplitude of the applied RF voltage can decrease from a maximum value, e.g., 1000 volts, to a minimum value, e.g., zero, over a given time period, e.g., over a time period in a range of about 0.1 ms to about 10 ms.

Figure 5B:
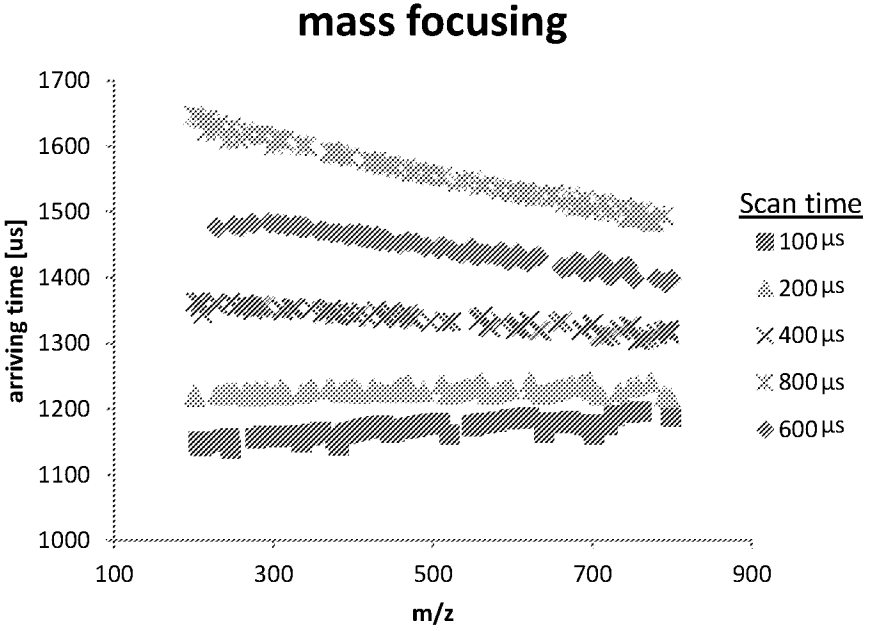
FIG. 5B depicts simulated arrival times of ions having a wide range of m/z ratios for different scanned RF voltages applied to selected electrodes of the curved linear ion trap of an ion trap according to FIG. 5A.

By way of illustration, FIG. 5B depicts simulated arrival times of ions having a wide range of m/z ratios, (e.g., in a range of 200 to 800), for different RF scan durations (i.e., scan times in a range of 100 microseconds to 800 microseconds). The simulated data demonstrates that for an RF scan time of 200 microseconds, the dependence of ion arrival times on m/z ratio substantially vanishes (e.g., ions across the range of about 200-800 m/z arrive at approximately 1200 microseconds). In other words, for an RF scan time of 200 microseconds, mass focusing is achieved.

Figure 6:
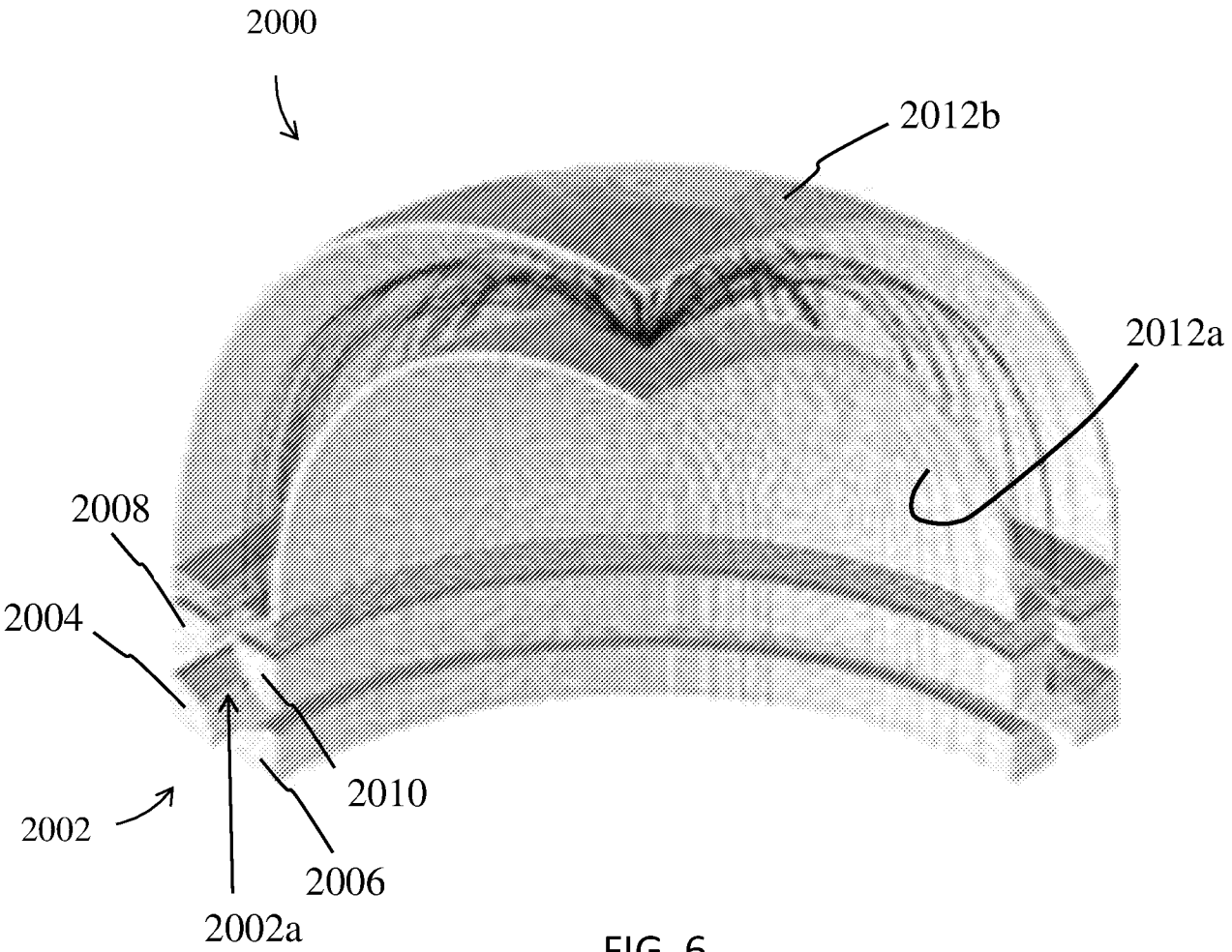
FIG. 6 is a schematic view of an ion trap according to various aspects of the present teachings, which includes a quadrupole curved linear ion trap.

Although the above-described curved linear ion trap includes four electrically-connected pairs of electrodes 1008 (e.g., slotted electrodes) providing a quadrupolar field for trapping ions, it will be appreciated that other configurations of curved linear ion traps can be employed. By way of example, FIG. 6 schematically depicts an ion trap 2000 according to another embodiment, which includes a quadrupolar linear curved ion trap 2002 comprising four curved quadrupole rods: outer lower electrode 2004, inner lower electrode 2006, outer upper electrode 2008, and inner upper electrode 2010 arranged so as to provide an ion trapping volume therebetween. Ions can be injected into the linear curved ion trap 2002 via an input orifice 2002*a* thereof. The application of RF voltage(s) to the quadrupole rods can generate a quadrupole field within the ion trapping volume for trapping selected ions therein, in a manner known in the art. For example, suitable RF voltages can be applied to the electrodes 2004, 2006, 2008, 2010 such that adjacent electrodes exhibit the opposite phase to the adjacent electrode to provide a trapping electric field. Similar to the previous embodiment, the ion trap 2002 includes two spherically-shaped ion guide electrodes 2012*a*/2012*b* disposed relative to the curved linear ion trap to receive ions ejected from the trap 2002 and to guide those ions to spatial locations between the two spherically-shaped ion guide electrodes along a focal line. However, rather than ions being ejected through a slot of two electrically-connected electrodes (e.g., 1008*g*/1008*h*) of an electrode pair as in FIG. 2, the ions of FIG. 6 can be ejected through the space between the upper outer and inner quadrupole electrodes 2008/2010. As above, an electrostatic lens can be optionally provided to help focus the ejected ions into the space between the ion guide electrodes 2012*a*/2012*b*. Similar to the discussion of the figures above, a DC extraction voltage can be applied to the electrodes 2004 and 2006 to eject the ions from the curved linear ion trap into the space between the ion guide electrodes 2012*a*/2012*b*. Likewise, mass focusing of the ejected ions can be achieved by applying a suitable scanned RF voltage in accordance with various aspects of the present teachings.

An ion trap according to the present teachings comprising a curved linear ion trap and a DC ion guide, which can be formed, e.g., of two spherically-shaped electrodes, can be incorporated in a variety of different mass spectrometers, for example, a time-of-flight (ToF), an FT-ICR or an orbitrap mass spectrometer, as well as in other types of ion handling devices that require fine focusing.

Figure 7:
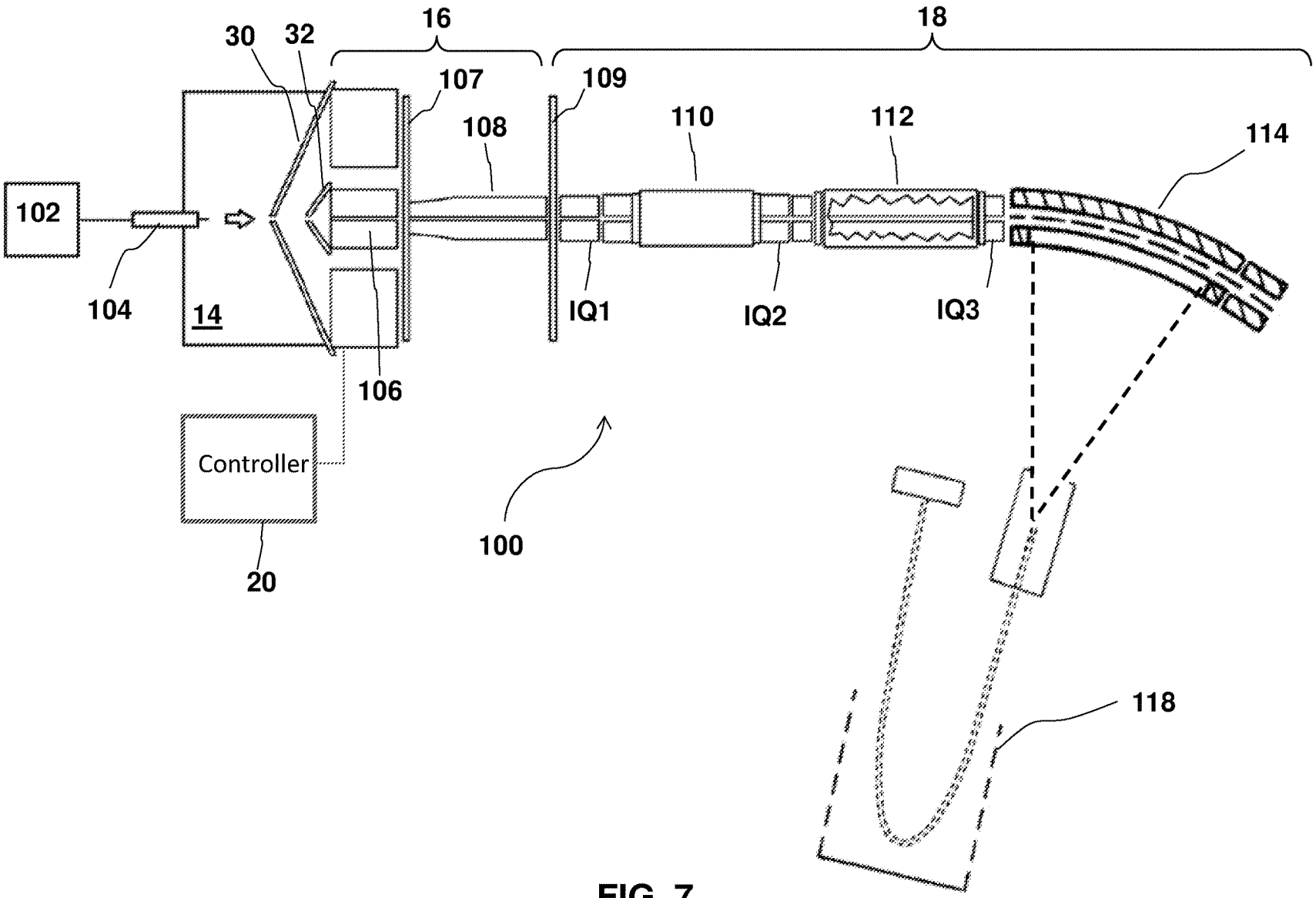
FIG. 7 schematically depicts a time-of-flight mass spectrometer in which an ion trap according to various aspects of the present teachings is incorporated.

FIG. 7 schematically depicts an exemplary mass spectrometer system 100 in which an ion trap according to the present teachings can be incorporated. It should be understood that the mass spectrometer system 100 represents only one possible mass spectrometer instrument for use in accordance with various aspects of the systems, devices, and methods described herein, and mass spectrometers having other configurations can all be used in accordance with the systems, devices and methods described herein as well.

As shown schematically in the exemplary embodiment depicted in FIG. 7, the mass spectrometer system 100 generally comprises a quadrupole ToF mass spectrometer, modified in accordance with various aspects of the present teachings. Other non-limiting, known or hereafter developed mass spectrometer systems that can be modified in accordance various aspects of the present teachings can also be utilized in conjunction with the systems, devices, and methods disclosed herein. For instance other suitable mass spectrometers include single quadrupole, triple quadrupole, ToF, trap, and hybrid analyzers.

As shown in FIG. 7, the exemplary mass spectrometer system 100 comprises an ion source 104 for generating ions within an ionization chamber 14, an upstream section 16 for initial processing of ions received therefrom, and a downstream section 18 containing one or more mass analyzers, collision cell, and a time-of-flight detector 118. Ions generated by the ion source 104 can be successively transmitted through the elements of the upstream section 16 (e.g., curtain plate 30, orifice plate 32, Qjet 106, and Q0 108) to result in a narrow and highly focused ion beam (e.g., in the z-direction along the central longitudinal axis) for further mass analysis within the high vacuum downstream portion 18. In the depicted embodiment, the ionization chamber 14 can be maintained at atmospheric pressure, though in some embodiments, the ionization chamber 14 can be evacuated to a pressure lower than atmospheric pressure. The curtain chamber (i.e., the space between curtain plate 30 and orifice plate 32) can also be maintained at an elevated pressure (e.g., about atmospheric pressure, a pressure greater than the upstream section 16), while the upstream section 16, and downstream section 18 can be maintained at one or more selected pressures (e.g., the same or different sub-atmospheric pressures, a pressure lower than the ionization chamber) by evacuation through one or more vacuum pump ports (not shown). The upstream section 16 of the mass spectrometer system 100 is typically maintained at one or more elevated pressures relative to the various pressure regions of the downstream section 18, which typically operate at reduced pressures so as to promote tight focusing and control of ion movement.

The ionization chamber 14, within which analytes contained within the fluid sample discharged from the ion source 104 can be ionized, is separated from a gas curtain chamber by a curtain plate 30 defining a curtain plate aperture in fluid communication with the upstream section via the sampling orifice of an orifice plate 32. In accordance with various aspects of the present teachings, a curtain gas supply can provide a curtain gas flow (e.g., of $N_2$) between the curtain plate 30 and orifice plate 32 to aid in keeping the downstream section of the mass spectrometer system clean by declustering and evacuating large neutral particles. By way of example, a portion of the curtain gas can flow out of the curtain plate aperture into the ionization chamber 14, thereby preventing the entry of droplets through the curtain plate aperture.

As discussed below, the mass spectrometer system 100 also includes a power supply (not shown) and controller 20 that can be coupled to the various components so as to operate the mass spectrometer system 100 in accordance with various aspects of the present teachings.

As shown, the depicted system 100 includes a sample source 102 configured to provide a fluid sample to the ion source 104. The sample source 102 can be any suitable sample inlet system known to one of skill in the art and can be configured to contain and/or introduce a sample (e.g., a liquid sample containing or suspected of containing an analyte of interest) to the ion source 104. The sample source 102 can be fluidly coupled to the ion source so as to transmit a liquid sample to the ion source 102 (e.g., through one or more conduits, channels, tubing, pipes, capillary tubes, etc.) from a reservoir of the sample to be analyzed, from an in-line liquid chromatography (LC) column, from a capillary electrophoresis (CE) instrument, or an input port through which the sample can be injected, all by way of non-limiting examples. In some aspects, the sample source 102 can comprise an infusion pump (e.g., a syringe or LC pump) for continuously flowing a liquid carrier to the ion source 104, while a plug of sample can be intermittently injected into the liquid carrier.

The ion source 104 can have a variety of configurations but is generally configured to generate ions from analytes contained within a sample (e.g., a fluid sample that is received from the sample source 102). In the exemplary embodiment depicted in FIG. 7, the ion source 104 comprises an electrospray electrode, which can comprise a capillary fluidly coupled to the sample source 102 and which terminates in an outlet end that at least partially extends into the ionization chamber 14 to discharge the liquid sample therein. As will be appreciated by a person skilled in the art in light of the present teachings, the outlet end of the electrospray electrode can atomize, aerosolize, nebulize, or otherwise discharge (e.g., spray with a nozzle) the liquid sample into the ionization chamber 14 to form a sample plume comprising a plurality of micro-droplets generally directed toward (e.g., in the vicinity of) the curtain plate aperture. As is known in the art, analytes contained within the micro-droplets can be ionized (i.e., charged) by the ion source 104, for example, as the sample plume is generated. In some aspects, the outlet end of the electrospray electrode can be made of a conductive material and electrically coupled to a power supply (e.g., voltage source) operatively coupled to the controller 20 such that as fluid within the micro-droplets contained within the sample plume evaporate during desolvation in the ionization chamber 12, bare charged analyte ions or solvated ions are released and drawn toward and through the curtain plate aperture. In some alternative aspects, the discharge end of the sprayer can be non-conductive and spray charging can occur through a conductive union or junction to apply high voltage to the liquid stream (e.g., upstream of the capillary). Though the ion source 104 is generally described herein as an electrospray electrode, it should be appreciated that any number of different ionization techniques known in the art for ionizing analytes within a sample and modified in accordance with the present teachings can be utilized as the ion source 104. By way of non-limiting example, the ion source 104 can be an electrospray ionization device, a nebulizer assisted electrospray device, a chemical ionization device, a nebulizer assisted atomization device, a matrix-assisted laser desorption/ionization (MALDI) ion source, a photoionization device, a laser ionization device, a thermospray ionization device, an inductively coupled plasma (ICP) ion source, a sonic spray ionization device, a glow discharge ion source, and an electron impact ion source, DESI, among others. It will be appreciated that the ion source 102 can be disposed orthogonally relative to the curtain plate aperture and the ion path axis such that the plume discharged from the ion source 104 is also generally directed across the face of the curtain plate aperture such that liquid droplets and/or large neutral molecules that are not drawn into the curtain chamber can be removed from the ionization chamber 14 so as to prevent accumulation and/or recirculation of the potential contaminants within the ionization chamber. In various aspects, a nebulizer gas can also be provided (e.g., about the discharge end of the ion source 102) to prevent the accumulation of droplets on the sprayer tip and/or direct the sample plume in the direction of the curtain plate aperture.

In some embodiments, upon passing through the orifice plate 32, the ions can traverse one or more additional vacuum chambers and/or quadrupoles (e.g., a QJet® quadrupole) to provide additional focusing of and finer control over the ion beam using a combination of gas dynamics and radio frequency fields prior to being transmitted into the downstream high-vacuum section 18. In accordance with various aspects of the present teachings, it will also be appreciated that the exemplary ion guides described herein can be disposed in a variety of front-end locations of mass spectrometer systems. By way of non-limiting example, the ion guide 108 can serve in the conventional role of a QJet® ion guide (e.g., operated at a pressure of about 1-10 Torr), as a conventional Q0 focusing ion guide (e.g., operated at a pressure of about 3-15 mTorr) preceded by a QJet® ion guide, as a combined Q0 focusing ion guide and QJet® ion guide (e.g., operated at a pressure of about 3-15 mTorr), or as an intermediate device between a the QJet® ion guide and Q0 (e.g., operated at a pressure in the 100s of mTorrs, at a pressure between a typical QJet® ion guide and a typical Q0 focusing ion guide).

As shown, the upstream section 16 of system 100 is separated from the curtain chamber via orifice plate 32 and generally comprises a first RF ion guide 106 (e.g., Qjet® of SCIEX) and a second RF guide 108 (e.g., Q0). In some exemplary aspects, the first RF ion guide 106 can be used to capture and focus ions using a combination of gas dynamics and radio frequency fields. By way of example, ions can be transmitted through the sampling orifice, where a vacuum expansion occurs as a result of the pressure differential between the chambers on either side of the orifice plate 32. By way of non-limiting example, the pressure in the region of the first RF ion guide can be maintained at about 2.5 Torr pressure. The Qjet 106 transfers ions received thereby to subsequent ion optics such as the Q0 RF ion guide 108 through the ion lens IQ0 107 disposed therebetween. The Q0 RF ion guide 108 transports ions through an intermediate pressure region (e.g., in a range of about 1 mTorr to about 10 mTorr) and delivers ions through the IQ1 lens 109 to the downstream section 18 of system 100.

The downstream section 18 of system 10 generally comprises a high vacuum chamber containing the one or more mass analyzers for further processing of the ions transmitted from the upstream section 16. As shown in FIG. 7, the exemplary downstream section 18 includes a mass analyzer 110 (e.g., elongated rod set Q1) and a second elongated rod set 112 (e.g., q2) that can be operated as a collision cell. The downstream section further includes an ion trap 114 according to the present teachings and a time-of-flight detector 118 configured to receive ions rejected from the ion trap 114, though more or fewer mass analyzer elements can be included in systems in accordance with the present teachings. Mass analyzer 110 and collision cell 112 are separated by orifice plates IQ2, and collision cell 112 and the ion trap 114 are separated by orifice plate IQ3. For example, after being transmitted from 108 Q0 through the exit aperture of the lens 109 IQ1, ions can enter the adjacent quadrupole rod set 110 (Q1), which can be situated in a vacuum chamber that can be evacuated to a pressure that can be maintained lower than that of chamber in which RF ion guide 107 is disposed. By way of non-limiting example, the vacuum chamber containing Q1 can be maintained at a pressure less than about $1\times10^{-4}$ Torr (e.g., about $5\times10^{-5}$ Torr), though other pressures can be used for this or for other purposes. As will be appreciated by a person of skill in the art, the quadrupole rod set Q1 can be operated as a conventional transmission RF/DC quadrupole mass filter that can be operated to select an ion of interest and/or a range of ions of interest. By way of example, the quadrupole rod set Q1 can be provided with RF/DC voltages suitable for operation in a mass-resolving mode. As should be appreciated, taking the physical and electrical properties of Q1 into account, parameters for an applied RF and DC voltage can be selected so that Q1 establishes a transmission window of chosen m/z ratios, such that these ions can traverse Q1 largely unperturbed. Ions having m/z ratios falling outside the window, however, do not attain stable trajectories within the quadrupole and can be prevented from traversing the quadrupole rod set Q1. It should be appreciated that this mode of operation is but one possible mode of operation for Q1. By way of example, the lens IQ2 between Q1 and q2 can be maintained at a higher offset potential than Q1 such that the quadrupole rod set Q1 be operated as an ion trap. In some aspects, the ions can be Mass-Selective-Axially Ejected from the Q1 ion trap in a manner described by Hager in "*A new Linear ion trap mass spectrometer*," Rapid Commun. Mass Spectro. 2002; 16: 512-526, and accelerated into q2, which could also be operated as an ion trap, for example. Ions passing through the quadrupole rod set Q1 can pass through the lens IQ2 and into the adjacent quadrupole rod set q2, which can be disposed in a pressurized compartment and can be configured to operate as a collision cell at a pressure approximately in the range of from about 1 mTorr to about 10 mTorr, though other pressures can be used for this or for other purposes. A suitable collision gas (e.g., nitrogen, argon, helium, etc.) can be provided by way of a gas inlet (not shown) to thermalize and/or fragment ions in the ion beam. In some embodiments, the quadrupole rod set q2 and entrance and exit lenses IQ2 and IQ3 can also be configured as an ion trap. Ions that are transmitted by q2 can pass into the ion trap 114, which can be implemented, for example, as the ion trap 1000 described above with reference to FIGS. 2 and 6, for example.

As will be appreciated by a person skilled in the art, the ion trap 114 can be operated at a decreased operating pressure relative to that of q2, for example, less than about $1\times10^{-4}$ Torr (e.g., about $5\times10^{-5}$ Torr), though other pressures can be used for this or for other purposes. It will also be appreciated by those skilled in the art that the downstream section 18 can additionally include additional ion optics, including RF-only stubby ion guides (which can serve as a Brubaker lens) as schematically depicted. Typical ion guides of ion guide regions Q0, Q1, and q2 and stubbies ST1, ST2 and ST3 in the present teachings, can include at least one electrode as generally known in the art, in addition to ancillary components generally required for structural support. For convenience, the mass analyzer 110 and collision cell 112 are generally referred to herein as quadrupoles (that is, they have four rods), though the elongated rod sets can be any other suitable multipole configurations, for example, hexapoles, octapoles, etc. It will also be appreciated that the one or more mass analyzers can be any of triple quadrupoles, single quadrupoles, time of flights, linear ion traps, quadrupole time of flights, Orbitrap or other Fourier transform mass spectrometers, all by way of non-limiting example.

Following processing or transmission through the ion trap 114, the ions can be focused into a ToF detector 118 (or trap analyzer as depicted in FIG. 7). The detector 118 can then be operated in a manner known to those skilled in the art in view of the systems, devices, and methods described herein. As will be appreciated by a person skill in the art, any known detector, modified in accord with the teachings herein, can be used to detect the ions.

Figure 8:
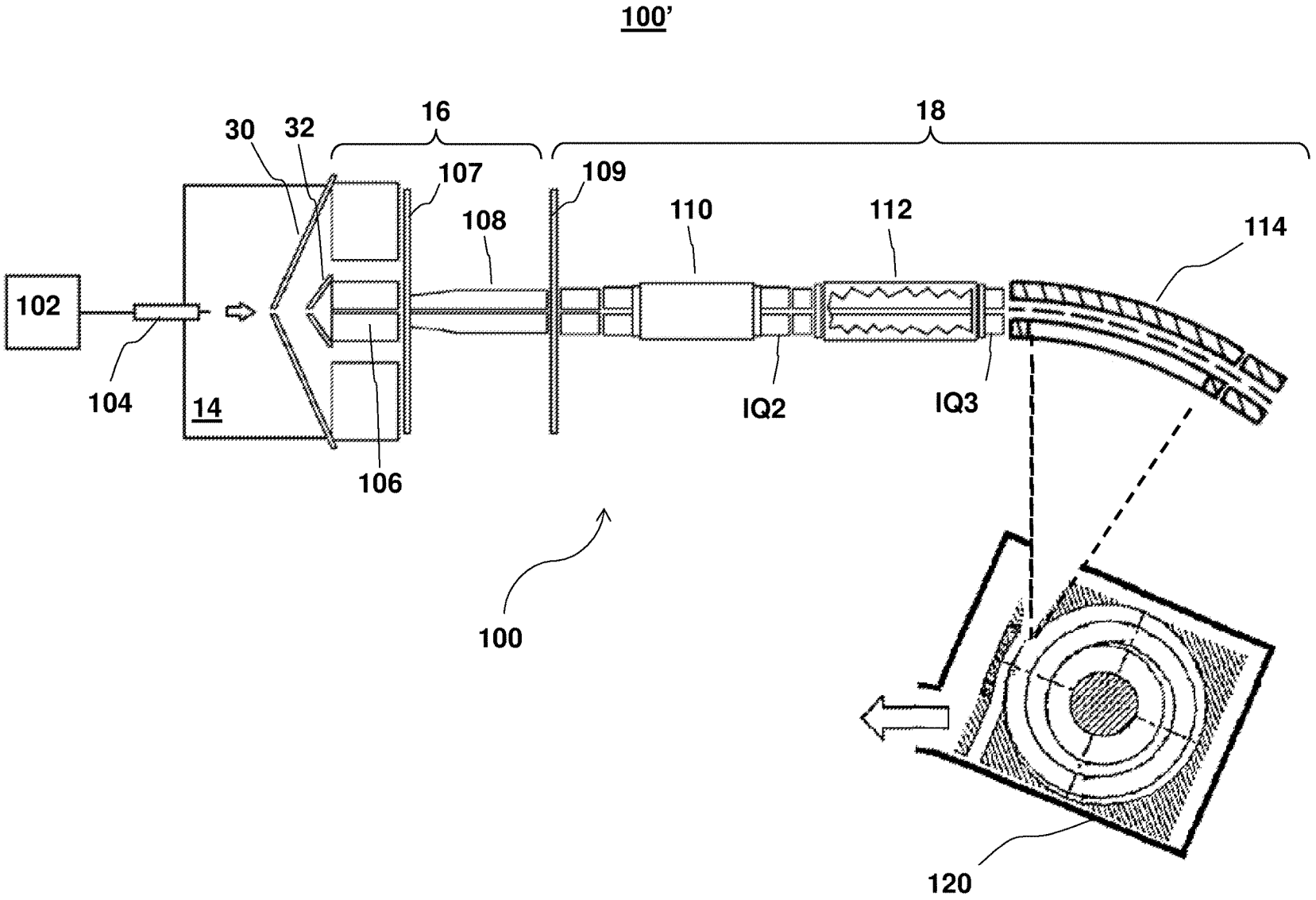
FIG. 8 schematically depicts a side-on FT-ICR mass spectrometer in which an ion trap according to various aspects of the present teachings is incorporated.

By way of further illustration, FIG. 8 schematically depicts the incorporation of an ion trap according to the present teachings in a mass spectrometer 100' that includes the same components as those employed in the previous mass spectrometer 100 except that it includes a side-on FT mass analyzer 120 that is configured to receive ions ejected from the ion trap 114.

The section headings used herein are for organizational purposes only and are not to be construed as limiting. While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art.

The invention claimed is:

1. An ion trap, comprising:

a curved linear ion trap having a plurality of electrodes arranged around a central curved axis to provide a volume for trapping ions, said plurality of electrodes comprising at least one inner electrode and at least one outer electrode radially separated from said inner electrode, a pair of inner and outer ion guide electrodes providing a volume therebetween for receiving ions ejected from said curved ion trap and guiding the ejected ions to one or more spatial locations along a focal line, said inner and outer ion guide electrodes being positioned external to said ion trapping volume and in proximity of said at least inner and outer electrodes of the curved ion trap, respectively, wherein each of said ion guide electrodes is in the form of a truncated spherical surface, and wherein a DC voltage is applied between said ion guide electrodes to provide an electric field therebetween for guiding the ejected ions to said focal line.

2. The ion trap of claim 1, wherein said ion guide electrodes are configured to receive the ejected ions along directions substantially orthogonal to said central axis.

3. The ion trap of claim 1, further comprising a voltage source for applying a DC voltage to at least one electrode of the curved linear ion trap for ejecting at least a portion of the trapped ions into the volume between the ion guide electrodes.

4. The ion trap of claim 3, wherein said voltage source is configured to apply a switchable DC voltage to said at least one electrode, the system further comprising an RF generator configured to apply a scanned RF voltage to the plurality of the electrodes of the curved linear ion trap so as to provide mass focusing of the ejected ions on said focal line.

5. The ion trap of claim 1, wherein said spherical surfaces are positioned concentrically relative to one another.

6. The ion trap of claim 5, wherein said focal line is disposed along a radial center axis of each of said spherical surfaces.

7. The ion trap of claim 1, further comprising a radiofrequency (RF) generator for applying one or more ion trapping RF voltages to one or more of electrodes of the curved linear ion trap for trapping the ions therein.

8. The ion trap of claim 7, wherein said one or more ion trapping RF voltages have a frequency in a range of about 0.1 MHz to about 10 MHz.

9. The ion trap of claim 1, wherein said curved linear ion trap comprises an quadrupole trap.

10. The ion trap of claim 1, wherein said at least one inner electrode comprises a pair of electrically-connected inner electrodes, said at least one outer electrode comprises a pair of electrically-connected outer electrodes, and said quadrupole further comprises a pair of electrically-connected bottom electrodes and a pair of electrically-connected top electrodes.

11. The ion trap of claim 1, wherein a RF generator is configured to apply at least one scanned RF voltage to at least one of the electrodes of the curved linear ion trap for a selected time duration so as to achieve mass focusing of the ejected ions.

12. The ion trap of claim 11, wherein said scanned RF voltage is applied for a time duration in a range of about 0.1 ms to about 10 ms.

13. The ion trap of claim 12, wherein said scanned RF voltage has a frequency in a range of about 0.1 MHz to about 10 MHz.

14. The ion trap of claim 13, wherein said scanned RF voltage has an amplitude in a range of about 10 volts to about 1000 volts.

15. The ion trap of claim 1, further comprising a DC focusing lens disposed between said curved linear ion trap and said inner and outer ion guide electrodes so as to focus the ejected ions into the volume between said ion guide electrodes.

16. The ion trap of claim 15, wherein said DC focusing lens comprises a stack of a plurality of electrode pairs, wherein each of said electrode pairs comprises two electrodes spaced from one another so as to provide a gap therebetween for passage of the ejected ions.

17. An ion trap device, comprising:

a linear curved ion trap comprising a plurality of curved electrodes arranged to provide a volume therebetween for storing ions, a DC ion guide comprising a plurality of spherically-shaped electrodes coupled to said linear curved ion trap so as to receive ions ejected from the linear curved ion trap and to guide said ions onto one or more spatial locations along a focal line.

18. The ion trap device of claim 17, wherein said spherically-shaped electrodes are concentrically positioned so as to have a common center of curvature.

19. The ion trap device of claim 18, wherein said focal line is along a radial line extending from said common center to said spherically-shaped surfaces.

20. A method of trapping ions, comprising:

injecting a plurality of ions into a curved linear ion trap, applying at least one RF voltage to said curved linear ion trap so as to trap said ions, applying a DC extraction voltage to said curved linear ion trap so as to eject at least a portion of said trapped ions into a volume between two spherically-shaped DC-biased electrodes coupled to said curved linear ion trap so as to guide said ions to one or more spatial locations within said volume.

* * * * *